US007243622B2

(12) United States Patent
Tsutsui et al.

(10) Patent No.: US 7,243,622 B2
(45) Date of Patent: Jul. 17, 2007

(54) TWO-STROKE INTERNAL COMBUSTION ENGINE

(75) Inventors: Kazuhiro Tsutsui, Tokyo (JP); Takuo Yoshizaki, Tokyo (JP); Shirou Yamaguchi, Tokyo (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 11/445,972

(22) Filed: Jun. 2, 2006

(65) Prior Publication Data

US 2006/0272600 A1 Dec. 7, 2006

(30) Foreign Application Priority Data

Jun. 7, 2005 (JP) ..... 2005-167084

(51) Int. Cl.
*F02B 25/22* (2006.01)

(52) U.S. Cl. ..... 123/73 PP; 123/73 R

(58) Field of Classification Search ..... 123/73 PP, 123/73 R, 73 A, 73 S
See application file for complete search history.

(56) References Cited

U.S. PATENT DOCUMENTS 6,367,432 B1 * 4/2002 Araki ..... 123/73 R
6,668,770 B2 * 12/2003 Carlsson et al. ..... 123/73 A
6,718,917 B2 * 4/2004 Andersson et al. ..... 123/73 PP
2002/0100438 A1 * 8/2002 Raffenberg et al. ..... 123/73 A
2003/0005895 A1 * 1/2003 Carlsson et al. ..... 123/73 A
2005/0139179 A1 * 6/2005 Mavinahally et al. ..... 123/73 A

OTHER PUBLICATIONS

Japanese Utility Model Laid-open Publication (Kokai) No. 57-53026 (1982).
Patent Abstracts of Japan, Application No. 07-280862, filed Oct. 27, 1995, Publication No. 09-125966 dated May 13, 1997 of Noguchi Sukenori.

* cited by examiner

*Primary Examiner*—Willis R. Wolfe
*Assistant Examiner*—Jason Benton
(74) *Attorney, Agent, or Firm*—Baker Botts L.L.P.

(57) ABSTRACT

A two-stroke internal combustion engine (1) includes one pair or two pairs of scavenging passageways (31, 32) of reverse flow system where scavenging outlet ports (31*b*, 32*b*) are opened to the cylinder bore (10*a*); the internal combustion engine being characterized in that an external air inlet port (42, 44, 46) for introducing external air into a combustion actuating chamber (15) formed over a piston (20) is formed at a portion of the cylinder (10) which is located closer to an exhaust port than a scavenging outlet port (31*b*, 32*b*) from which an air-fuel mixture (M) is introduced into the combustion actuating chamber (15) in a descending stroke of piston, and/or the external air inlet port (42, 44, 46) is formed at a portion of the cylinder (10) which enables the external air to be introduced into the combustion actuating chamber (15) prior to introduction of the air-fuel mixture (M).

13 Claims, 14 Drawing Sheets

TWO-STROKE INTERNAL COMBUSTION ENGINE

FIELD

The present invention relates generally to a two-stroke internal combustion engine which is suited for use for example in a portable power working machine, and in particular, to a two-stroke internal combustion engine which is capable of minimizing as much as possible the quantity of so-called blow-by or the quantity of air-fuel mixture to be discharged without being utilized for the combustion, thereby making it possible not only to improve the emission characteristics but also to enhance the fuel consumption and output.

BACKGROUND INFORMATION

An ordinary air cooling type small two-stroke gasoline engine which is conventionally used in a hand held type portable power working machine such as a chain saw and brush cutter is constructed such that an ignition plug is disposed at the head portion of the cylinder. An intake port, a scavenging port, and an exhaust port, which are to be opened and closed by a piston, are provided so as to communicate with the cylinder bore (or provided in the inner peripheral wall of the cylinder). According to this two-stroke internal combustion engine, one cycle of engine is accomplished by two strokes of the piston without undergoing a stroke which is exclusively assigned to the intake or exhaust of gas.

More specifically, in the ascending stroke of the piston, an air-fuel mixture consisting of a mixture comprising air, fuel and lubricant is introduced from the intake port into the crank chamber disposed below the piston. Then, in the descending stroke of the piston, the air-fuel mixture is pre-compressed in the crank chamber producing a compressed gas mixture, which is then blown from scavenging port into a combustion actuating chamber which is disposed above the piston, thereby enabling waste combustion gas to be discharged from the exhaust port. In other words, the scavenging of the waste combustion gas is effected by making use of the gas flow of the air-fuel mixture.

Therefore, the unburnt air-fuel mixture is more likely to be mingled into the combustion gas (exhaust gas), thus increasing the quantity of so-called blow-by or the quantity of air-fuel mixture to be discharged into air atmosphere without being utilized for the combustion. Because of this, as compared with a four-stroke engine, the two-stroke internal combustion engine is not only inferior in fuel consumption but also disadvantageous in that a large amount of poisonous components such as HC (unburnt components in a fuel) and CO (incomplete combustion components in a fuel) are included in the exhaust gas. Therefore, even if the two-stroke engine is small in capacity, the influence of these poisonous components on the environmental contamination should not be disregarded. Additionally, there are several problems as to how to address the regulation of exhaust gas which would become increasingly severe from now on. In particular, there are difficulties as to how to deal with the minimization of HC (total HC) in the exhaust gas.

With a view to overcome these drawbacks, there have been proposed various kinds of countermeasures. For example, as disclosed in JP Patent Laid-open Publication (Kokai) No. 9-125966 (1997), there has been proposed a two-stroke internal combustion engine of so-called air pre-introduction type (or stratified scavenging type) wherein an air inlet passageway for delivering external air to a scavenging passageway is installed, thus enabling the air to be introduced into the combustion actuating chamber in advance to the introduction of air-fuel mixture in the descending stroke of piston. Because of this structure, a layer of air is enabled to be formed between the waste combustion gas to be discharged and unburnt air-fuel mixture. Due to this air layer, the air-fuel mixture is prevented from being mixed with the waste combustion gas, thus making it possible to minimize the quantity of blow-by of air-fuel mixture.

Further, another type of two-stroke internal combustion engine of air pre-introduction type (or stratified scavenging type) is proposed in JP Utility Model Laid-open Publication (Kokai) No. 57-53026 (1982), wherein a sub-scavenging port which is designed to be opened prior to the opening of the main scavenging port is installed, and through this sub-scavenging port, air is supplied to the combustion actuating chamber by making use of a pump to be rotationally driven by a crankshaft.

According to these conventional two-stroke internal combustion engines described in these prior documents, it is possible to form a 3-ply layer consisting of a lower layer (piston side) constituted by waste combustion gas, an intermediate layer constituted by air, and an upper layer constituted by an air-fuel mixture, which are superimposed from top to bottom (vertical direction). As a result, it is possible to obtain stratified scavenging effects, to reduce the quantity of blow-by, and to improve the emission characteristics. According to these internal combustion engines of the prior art however, in order to deliver air to the combustion actuating chamber, it is necessary to install not only an air inlet passageway (generally, the air inlet passageway having a forked configuration should be installed, since one pair of right and left scavenging passageways or more than one pair of scavenging passageways are installed) but also a pump separate from and outside the main body of engine (cylinder and crankcase). Consequently, the structure surrounding the engine, inclusive of the air inlet passageway, would inevitably become complicated and heavier. Additionally, these internal combustion engines of the prior art are inconvenient in working and assembling, so that they should be further improved for suitably mounting them on a portable power working machine.

The present invention has been made under the circumstances described above, and therefore an object of the present invention is to provide a two-stroke internal combustion engine which can be manufactured at low cost without necessitating the tremendous modification of the structure thereof and which is capable of effectively suppressing the blow-by of unburnt air-fuel mixture, of improving emission characteristics, and of improving the fuel consumption and output of engine.

BRIEF SUMMARY OF THE INVENTION

With a view to realize the aforementioned object, the two-stroke internal combustion engine according to the present invention is basically constructed such that it includes at least one pair of scavenging passageways of reverse flow system where scavenging outlet ports are opened to the cylinder bore.

This two-stroke internal combustion engine is featured in that an external air inlet port for introducing external air into a combustion actuating chamber formed over a piston is formed at a portion of the cylinder which is located closer to an exhaust port than a scavenging outlet port from which an air-fuel mixture is introduced into the combustion actuating chamber in a descending stroke of piston, and/or the external air inlet port is formed at a portion of the cylinder which enables the external air to be introduced into the combustion actuating chamber prior to introduction of the air-fuel mixture.

Preferably, the external air inlet port is formed at a portion of the cylinder where air blasting from a fan to be driven by a crankshaft is applicable.

In this case, preferably, for the purpose of efficiently introducing the air blast into the combustion actuating chamber from the fan, a guiding wall is disposed in the vicinity of the external air inlet port.

In a preferable embodiment, at least one of scavenging inlet port of the scavenging passageways is closed and the external air inlet port is formed close to the scavenging outlet port of the closed scavenging passageway.

In another preferable embodiment, the two-stroke internal combustion engine includes two pairs of scavenging passageways and the scavenging inlet ports of at least one pair of the scavenging passageways are closed and the external air inlet port is formed close to each of the scavenging outlet ports of the pair of closed scavenging passageways.

In a further preferable embodiment, the two-stroke internal combustion engine is provided with a plurality of scavenging passageways and the external air inlet port is formed in at least one of the scavenging passageways which is disposed closer to the exhaust port among the plurality of scavenging passageways.

In a further preferable embodiment, the external air inlet port is formed at a portion of the cylinder, which is located closer to the exhaust port than where the scavenging passageways of the cylinder is located.

In a further preferable embodiment, the external air inlet port is formed in the vicinity of an intake port of the cylinder and inclined upward in the direction of combustion chamber of the cylinder and designed to be opened before the exhaust port is opened in the descending stroke of the piston.

According to a preferable embodiment of the two-stroke internal combustion engine of the present invention, which is constructed as described above, as the pressure of crank chamber is lowered in the ascending stroke of piston, the air-fuel mixture to be delivered from an air-fuel mixture-creating means such as a carburetor is sucked into the crank chamber and stored therein. Then, when the air-fuel mixture existing in the combustion actuating chamber disposed over the piston is ignited by electric spark and explosively burnt, the piston is pressed downward due to the effect of burnt gas. In the course of descending stroke of piston, the air-fuel mixture in the crank chamber and the scavenging passageway is compressed by the piston and, at first, the exhaust port is opened, and then, when the piston is further descended, the scavenging outlet port disposed at a downstream end of the scavenging passageway is opened. As a result, the air-fuel mixture that has been compressed in the scavenging passageway and the crank chamber is ejected, as a scavenging gas flow having a predetermined horizontal scavenging angle, toward the bore wall of the cylinder which is located opposite to the exhaust port. Then, this ejected scavenging gas is impinged against the bore wall, causing this ejected scavenging gas to turn toward the exhaust port.

In the two-stroke internal combustion engine of the present invention described herein, the external air introduced from the external air inlet port provided in the scavenging passageway is introduced into the cylinder through a portion of the cylinder which is located closer to an exhaust port than a portion of the cylinder through which an air-fuel mixture is introduced into the combustion actuating chamber from the scavenging outlet port in a descending stroke of piston. Namely, concurrent with descending stroke of piston, a 3-ply layer consisting of a layer of waste combustion gas disposed on the exhaust port side, a layer of air existing in the middle, and a layer of air-fuel mixture disposed on the intake port side (a sidewall located opposite to the exhaust port) is formed in a laterally stratified manner in contrast to the aforementioned prior art where the 3-ply layer is stratified from top to bottom (i.e. vertically). Further, since the external air inlet port is positioned at a location to which air blasting from a cooling fan to be driven by a crankshaft is applied, the quantity of air to be introduced into the combustion actuating chamber is made proportional to the rotating speed of engine. Since the air to be introduced into the combustion actuating chamber from this external air inlet port is introduced therein through a different route from that of the air-fuel mixture to be introduced from a carburetor, it is possible to obtain stratified scavenging effects on account of this introduced air. As a result, it is possible to minimize the quantity of blow-by, and to improve not only the emission characteristics but also the fuel consumption and output of engine.

Further, since only a specific portion of the cylinder is fundamentally required to be modified so as to form an external air inlet port of appropriate aperture in carrying out the present invention, it is no longer required to greatly modify the conventional engine, thus rendering the present invention highly advantageous in terms of manufacturing cost.

DETAILED DESCRIPTION OF THE PREFERRED EMBODIMENTS

Next, various embodiments of the two-stroke internal combustion engine according to the present invention will be explained with reference to the drawings.

Figure 1:
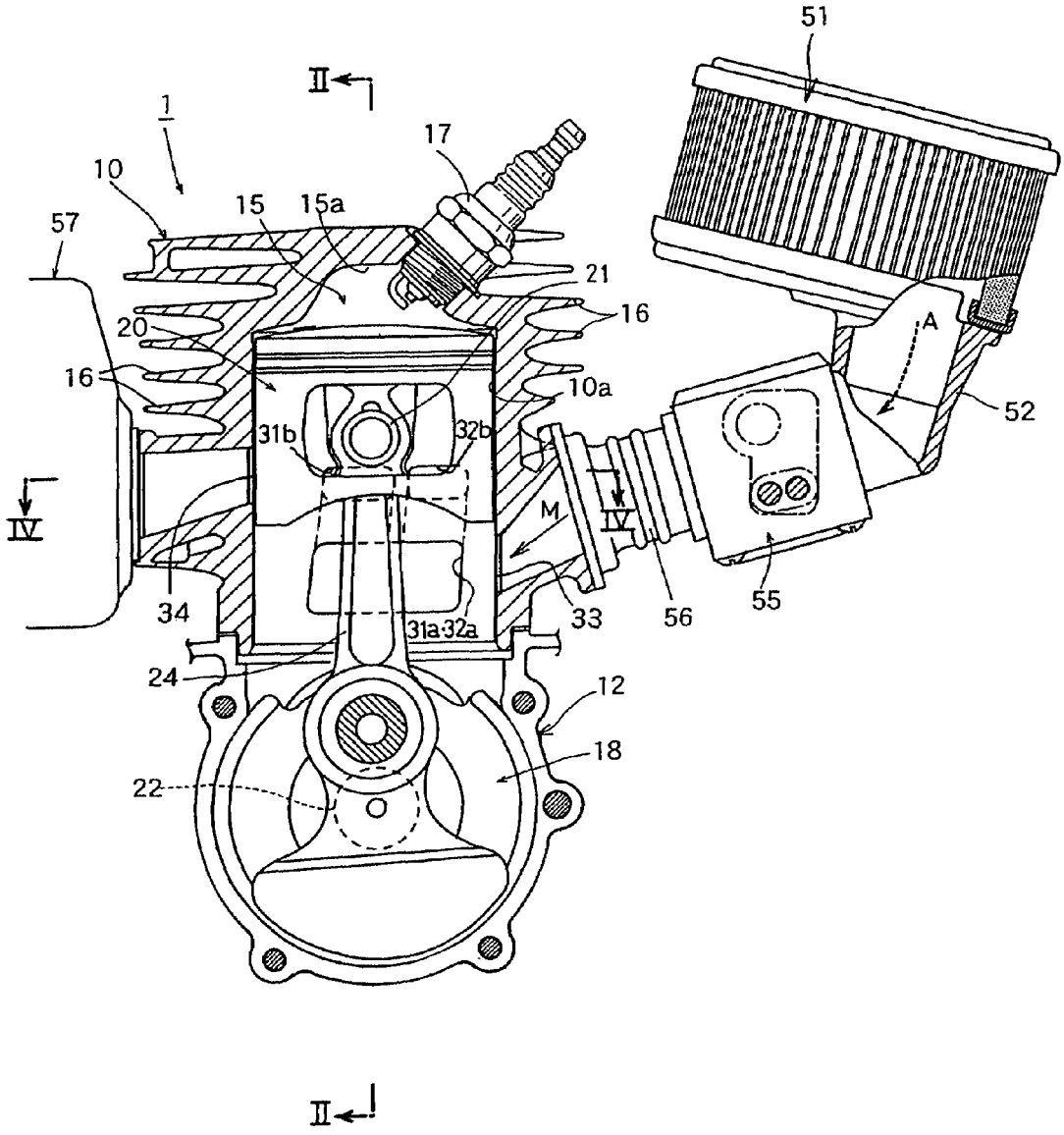
FIG. 1 is a longitudinal sectional view illustrating one embodiment of the fundamental structure of the two-stroke internal combustion engine according to the present invention, wherein the piston thereof is positioned at the bottom dead center.
Figure 2:
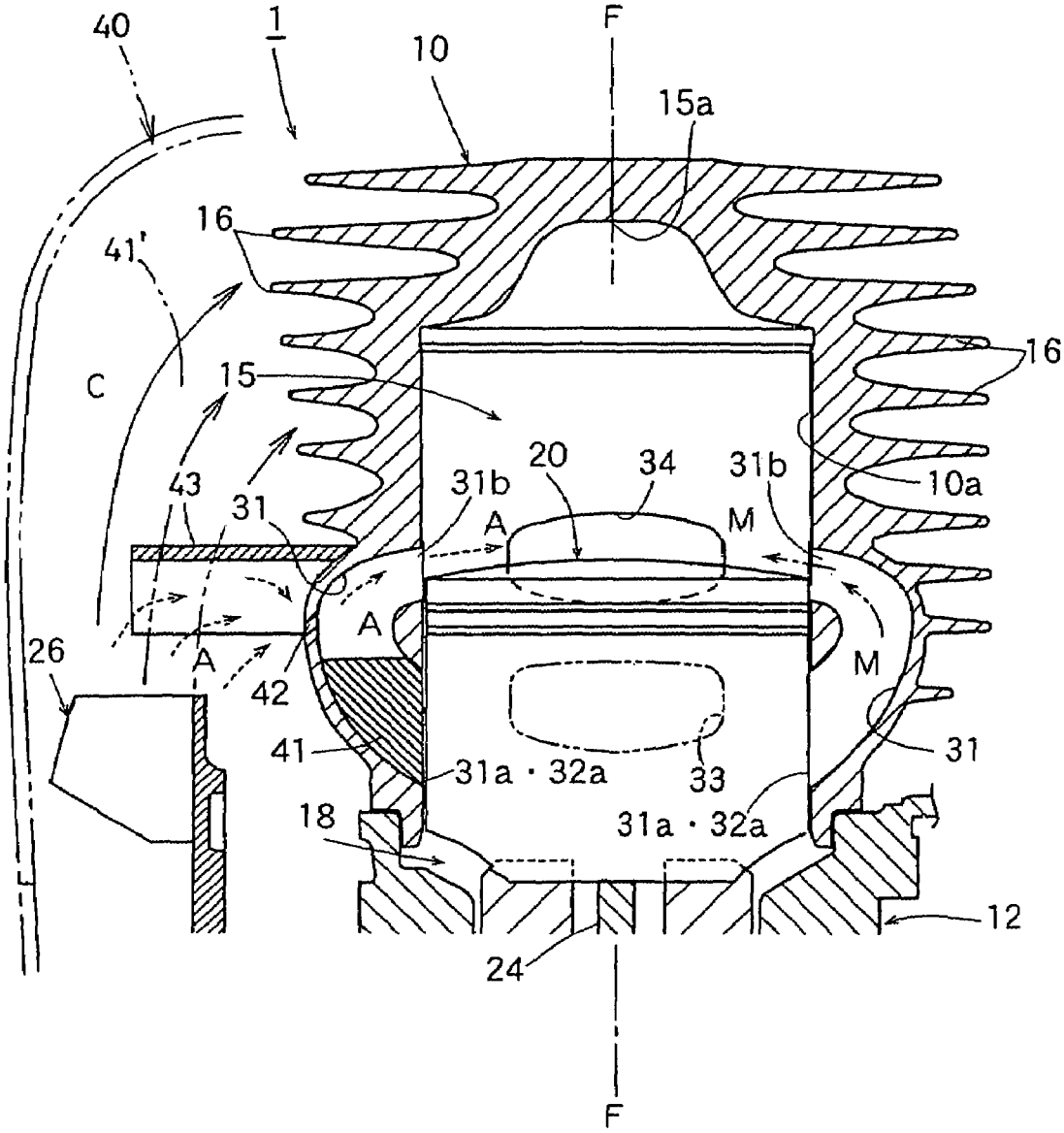
FIG. 2 is a longitudinal sectional view taken along the line II-II of FIG. 1 for illustrating a first embodiment of the present invention, wherein the piston is positioned close to the bottom dead center.
Figure 3:
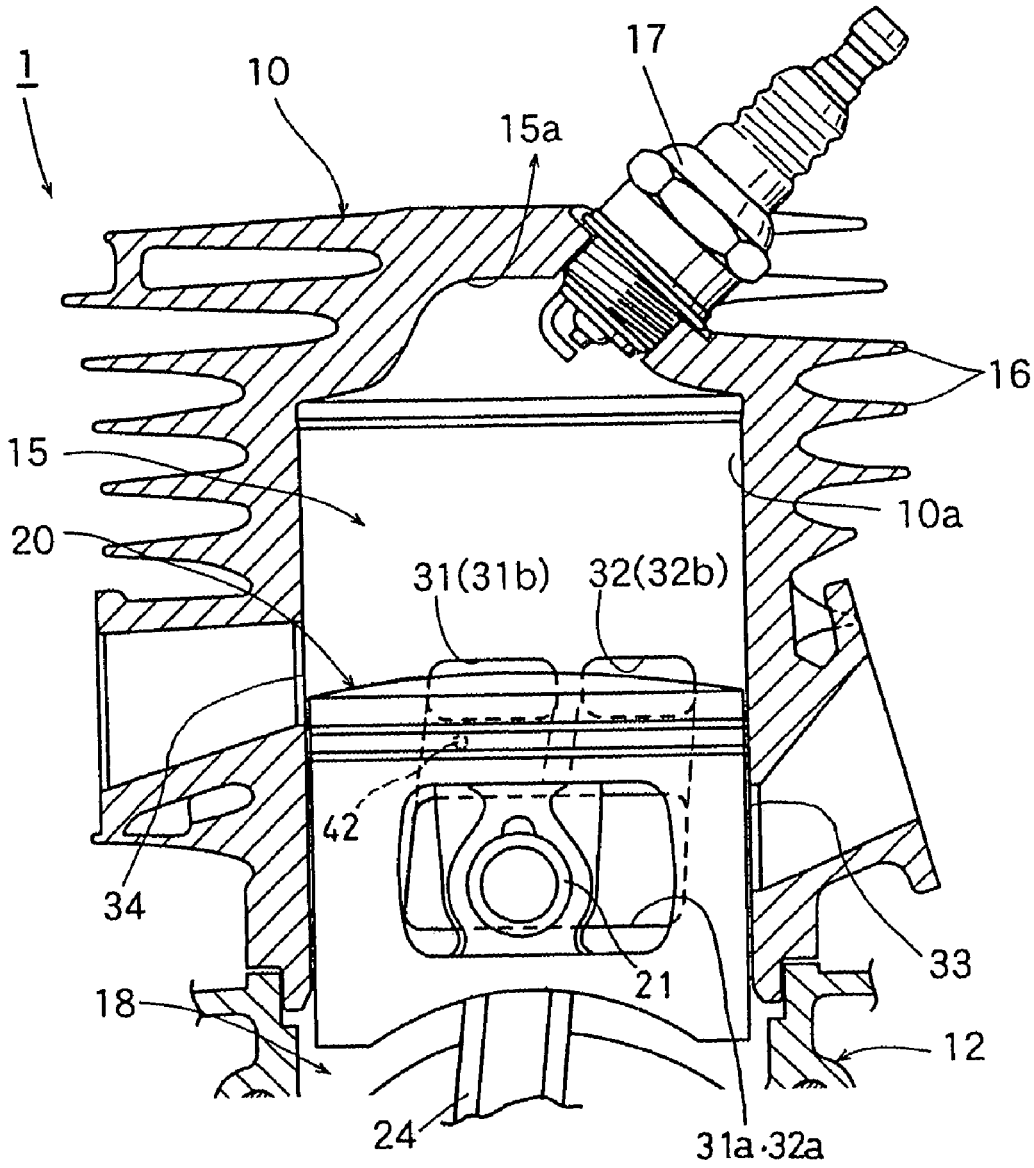
FIG. 3 is an enlarged longitudinal sectional view which corresponds to the structure shown in FIG. 1 for illustrating a first embodiment of the present invention, wherein the piston is positioned close to the bottom dead center.
Figure 4:
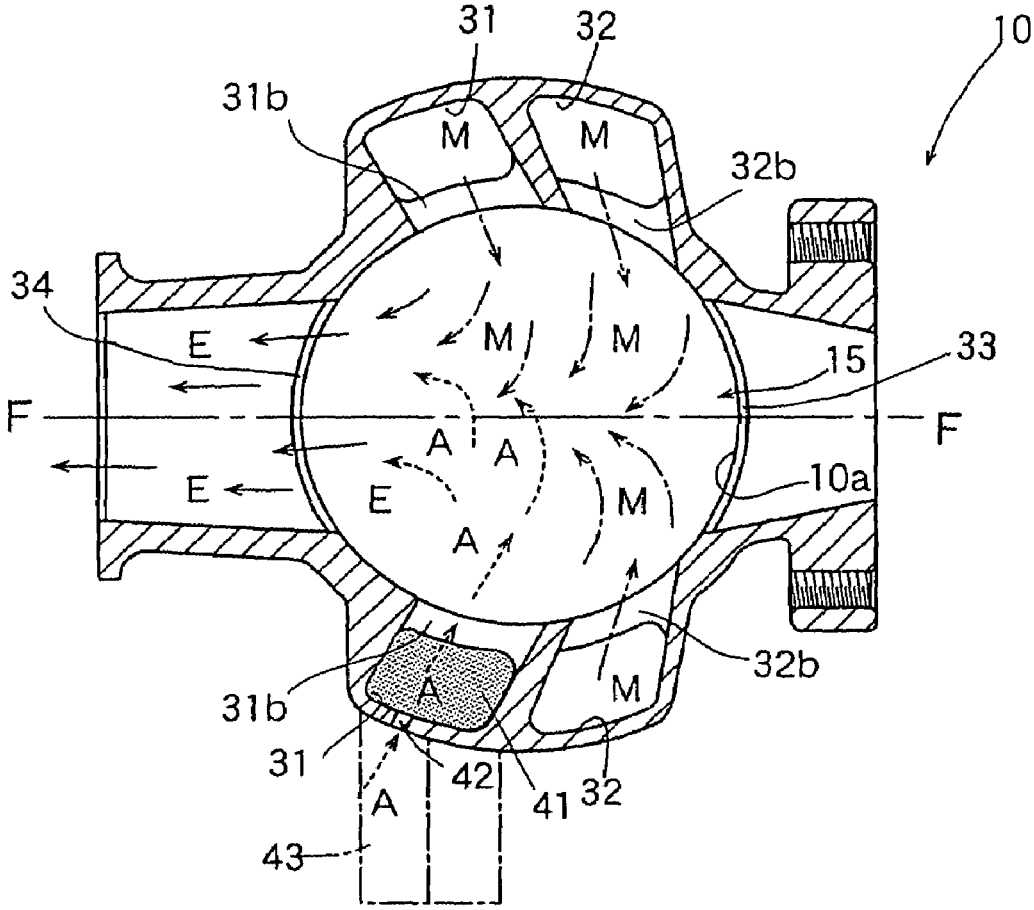
FIG. 4 shows a cross-sectional view taken along the line IV-IV of FIG. 1 for illustrating a first embodiment of the present invention.
Figure 13:
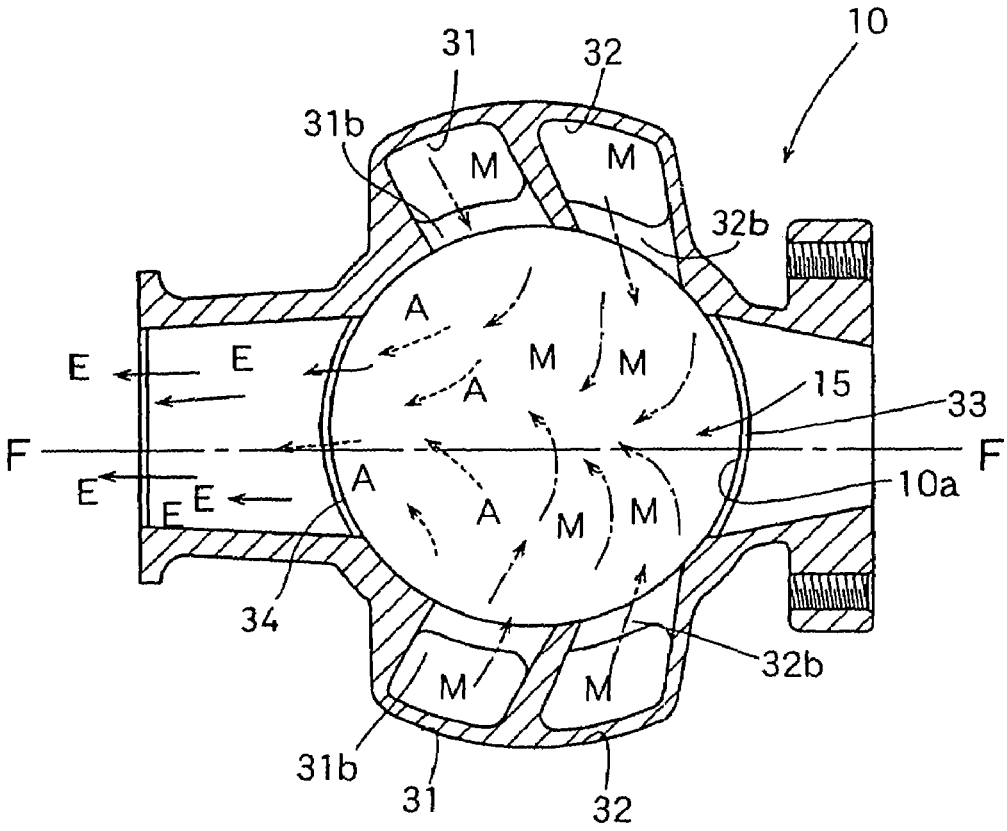
FIG. 13 shows a cross-sectional view corresponding to the structure shown in FIG. 4 for illustrating a fourth embodiment of the present invention.

FIG. 1 is a longitudinal sectional view illustrating one embodiment of the fundamental structure of the two-stroke internal combustion engine according to the present invention, wherein the piston thereof is positioned at the bottom dead center FIGS. 2, 3 and 4 all illustrate a first embodiment of the present invention, wherein FIG. 2 is a sectional view taken along the line II-II of FIG. 1, illustrating a state where the piston is positioned close to the bottom dead center; FIG. 3 is an enlarged longitudinal sectional view corresponding the structure shown in FIG. 1, illustrating a state where the piston is positioned close to the bottom dead center; and FIG. 4 shows a cross-sectional view taken along the line IV-IV of FIG. 1. In FIG. 4, the exhaust port 34, the intake port 33, and the external air-introducing port 42 are depicted as being positioned on the same surface for the convenience of explanation (this is the same in the cases of FIGS. 7, 9 and 13 to be illustrated hereinafter).

The two-stroke internal combustion engine 1 shown in FIG. 1 is formed of a small air-cooled two-stroke gasoline engine of quaternary scavenging type (for example, about 35 mL in displacement), which is adapted to be employed in a hand held type portable working machine. This engine 1 comprises a cylinder 10 in which a piston 20 is fittingly inserted so as to enable it to reciprocatively move up and down, and a crankcase 12 which is disposed below the cylinder 10 and hermetically fastened to the cylinder 10. The crankcase 12 defines a crank chamber 18 below the cylinder 10 and rotatably supports a crank shaft 22 which is employed for reciprocatively moving a piston 20 up and down through a piston pin 21 and a connecting rod 24.

The cylinder 10 is provided, on the outer circumferential wall thereof, with a large number of cooling fins 16, and, at the head portion thereof, with a dome-shaped (trapezoidal in sectional view) combustion chamber 15*a* constituting an upper portion of the combustion actuating chamber 15. An ignition plug 17 protrudes into the combustion chamber 15*a*.

An exhaust port 34 is provided penetrating one side of the cylinder bore 10*a* of the cylinder 10. On the opposite side of the cylinder bore 10*a*, there is provided an intake port (air-fuel mixture supply port) 33 which is disposed lower than the exhaust port 34 (i.e. on the crank chamber 18 side). A pair of first scavenging passages 31 (which are located on one side of the cylinder bore 10*a* located close to the exhaust port 34) and another pair of second scavenging passages 32 (which are located on the opposite side of the cylinder bore 10*a* located opposite to where the exhaust port 34 is disposed, i.e. close to the intake port 33), both respectively constituting a C-shaped scavenging passageway, are symmetrically provided on both sides of the longitudinal section F-F. This section F-F imaginatively divides, in widthwise, the exhaust port 34 and the intake port 33 into two equal parts, thus constituting a reverse scavenging system (Schnurle type scavenging system) where scavenging inlet ports 31*a*, 32*a* and scavenging outlet ports 31*b* and 32*b* are all opened to the cylinder bore 10*a*. The scavenging inlet ports 31*a*,32*a* are designed so as to respectively serve as a common inlet port for both of the first scavenging passages 31 and the second scavenging passages 32.

An air-fuel mixture M is introduced, via an air cleaner 51, a connecting tube 52, a carburetor 55 and a heat insulator 56, into the intake port 33. A muffler 57 is connected to the exhaust port 34.

The scavenging outlet ports 31*b* and 32*b*, which are provided at the upper ends (downstream ends) of the first scavenging passages 31 and the second scavenging passages 32, are respectively deflected horizontally so as to have a predetermined horizontal scavenging angle and are all disposed on the same level. Further, the location of the top edges of these scavenging outlet ports 31*b* and 32*b* is set lower, by a predetermined distance, than the top edge of the exhaust port 34. Therefore, in the descending stroke of the piston 20, these scavenging outlet ports 31*b* and 32*b* are all permitted to simultaneously open a moment later than the exhaust port 34.

The scavenging inlet ports 31*a* and 32*a*, which are provided at the lower ends (upstream ends) of the first scavenging passages 31 and the second scavenging passages 32, are respectively designed such that the effective opening area thereof is gradually decreased by the movement of the piston in the descending stroke (scavenging stroke) of the piston 20.

In this first embodiment, one of the scavenging passages (31) located closer to the exhaust port 34 among the entire scavenging passages 31 and 32 is blocked by stuffing a blocking member 41 made of a heat resistant synthetic resin into one end portion thereof, i.e. a portion where the scavenging inlet port 31*a* or 32*a* is located. This scavenging passage 31 whose inlet side is blocked in this manner includes, in the vicinity of the scavenging outlet port 31*b*, an external air inlet port 42 having an aperture of about 2 mm for example in order to directly introduce external air "A" into a region of the scavenging passage 31 which is located close to the exhaust port 34, prior to the introduction of air-fuel mixture M to be introduced into the combustion actuating chamber 15 from other scavenging outlet ports 31*b* and 32*b* in the descending stroke of the piston 20. More specifically, this external air inlet port 42 is formed passing through the outer wall of the scavenging passage in such a manner that it is inclined upward and the distal end thereof is directed toward the interior of the combustion actuating chamber 15 (see FIGS. 2 and 4).

Figure 5:
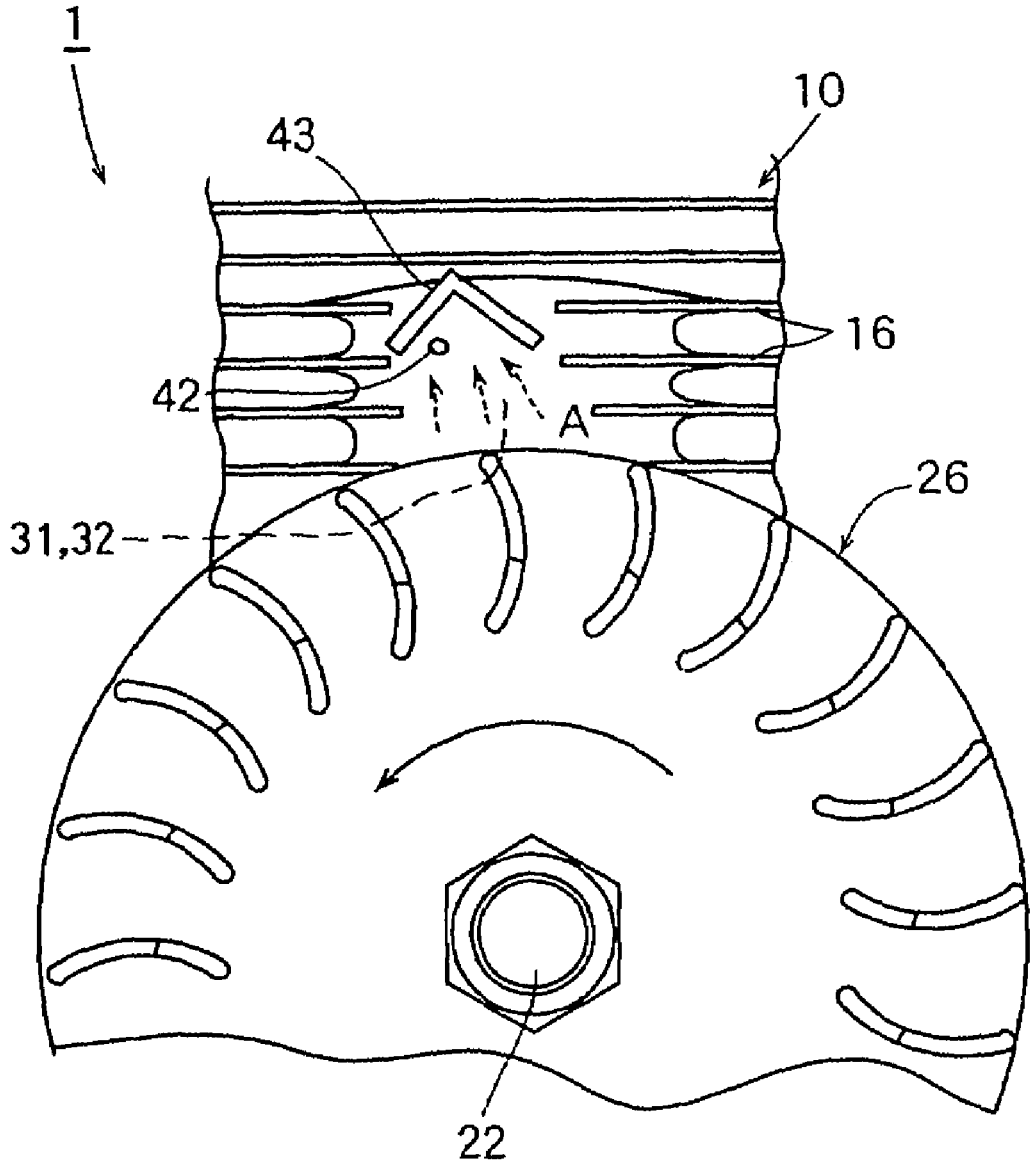
FIG. 5 is a partially cut side view for illustrating an external appearance of the external air inlet port and a guide wall, which are employed in the first embodiment the present invention.

Furthermore, this external air inlet port 42 is formed in the vicinity of a cooling fan 26 (see FIGS. 2 and 5) to be driven by the crankshaft 22. As a result, this external air inlet port 42 is subject to an air blast (strong air pressure) C ejected from the cooling fan 26 and flowing through a cooling air duct 41' formed inside a cowling 40. Further, in order to effectively introduce the air blast C into the combustion actuating chamber 15 from the cooling fan 26, a guide wall 43 having a inverted V-shaped cross-section is fixedly attached, as a blast receiving means, to a region near the external air inlet port 42 by means of welding, brazing, adhesion, etc. as shown in FIGS. 2, 4 and 5.

According to the two-stroke internal combustion engine 1 of this first embodiment which is constructed as described above, as the pressure in the crank chamber 18 is decreased in the ascending stroke of the piston 20, the air-fuel mixture M supplied from a carburetor 55 is sucked, via the intake port 33, into the crank chamber 18 and stored therein. When the air-fuel mixture M existing inside the combustion actuating chamber 15 disposed over the piston 20 is ignited by electric spark and explodes, the piston 20 is pushed downward due to the generation of a combustion gas E. During this descending stroke of the piston 20, the air-fuel mixture M existing in the crank chamber 18 and in the scavenging passages 31 (excluding one which is blocked) and 32 is compressed by the piston 20, and at the same time, the exhaust port 34 is opened at first, and when the piston 20 is further descended, the scavenging outlet ports 31*b* and 32*b* formed at the downstream ends of the scavenging passageways 31 and 32 are opened. The air-fuel mixture M that has been compressed in the scavenging passages 31 (excluding one which is blocked) and 32 and in the crank chamber 18 is ejected, as a scavenging air flow having a predetermined horizontal scavenging angle, from the scavenging outlet ports 31*b* (excluding one which is blocked) and 32*b* toward the wall of cylinder bore which is located opposite to the exhaust port 34. The air-fuel mixture M thus ejected is impinged against the wall of cylinder bore and then deflected.

In this embodiment, in the course of descending stroke of the piston 20, the external air "A" having a strong air pressure and ejected through the scavenging outlet port 31*b* from the external air inlet port 42 provided in the scavenging passage 31 (which is not blocked) is introduced into a region of the cylinder bore which is located closer to an exhaust port than a portion of the cylinder bore through which an air-fuel mixture M is introduced into the combustion actuating chamber 15 from the scavenging outlet ports 31*b* (excluding one which is blocked) and 32*b* in a descending stroke of piston 20. Namely, as shown in FIG. 4, concurrent with descending stroke of piston, a 3-ply layer consisting of a layer of waste combustion gas E disposed on the exhaust port 34 side, a layer of air "A" existing in the middle, and a layer of air-fuel mixture M disposed on the intake port 33 side (a sidewall located opposite to the exhaust port) is formed in a laterally stratified manner in contrast to the aforementioned manner where the 3-ply layer is stratified from top to bottom (i.e. vertically). Further, since the external air inlet port 42 is positioned at a location to which air blasting from a cooling fan 26 to be driven by a crankshaft 22 is applied, the quantity of air to be introduced into the combustion actuating chamber is proportional to the rotating speed of engine. Since the air "A" to be introduced into the combustion actuating chamber 15 from this external air inlet port 42 is introduced therein through a different route from that of the air-fuel mixture M to be introduced from the carburetor 55, it is possible to obtain stratiform scavenging effects on account of this introduced air "A". As a result, it is possible to minimize the quantity of blow-by, and to improve not only the emission characteristics but also the fuel consumption and output of engine.

Further, since only a specific portion of the cylinder 10 is fundamentally required to be modified so as to form an external air inlet port 42 of appropriate aperture in carrying out this embodiment, it is no longer required to greatly modify the conventional engine, thus rendering the present invention highly advantageous in terms of manufacturing cost.

Figure 14:
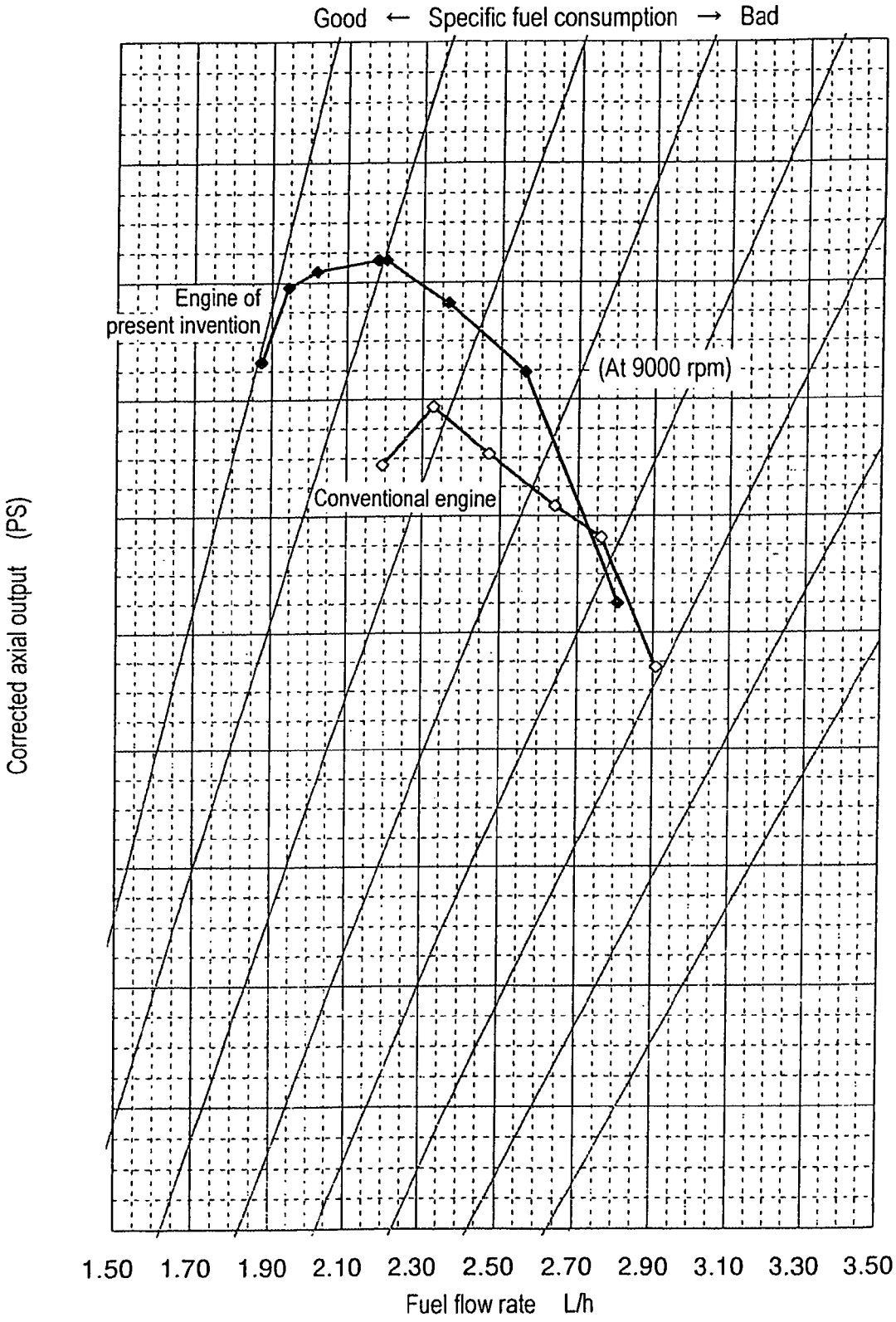
FIG. 14 is a graph showing the results of the comparative experiments performed to demonstrate the effects of the present invention.

With a view to prove the aforementioned effects, comparative tests were performed by making use of the conventional two-stroke internal combustion engine where the external air inlet port 42 as well as the blocking member 41 are not installed (the engine of the prior art), and the two-stroke internal combustion engine of this first embodiment (the engine of the present invention). In these comparative tests, the peak output and the quantity of consumed fuel (flow rate of fuel=fuel consumption) were measured under the same conditions, thus obtaining the results shown in FIG. 14. It was confirmed through these tests that it was possible, through the employment of the engine of the present invention, to enhance the peak output by about 5%, to enhance the fuel consumption by about 12%, and to reduce the discharge of HC (unburnt air-fuel mixture) by about 20% as compared with the engine of the prior art.

Figure 6:
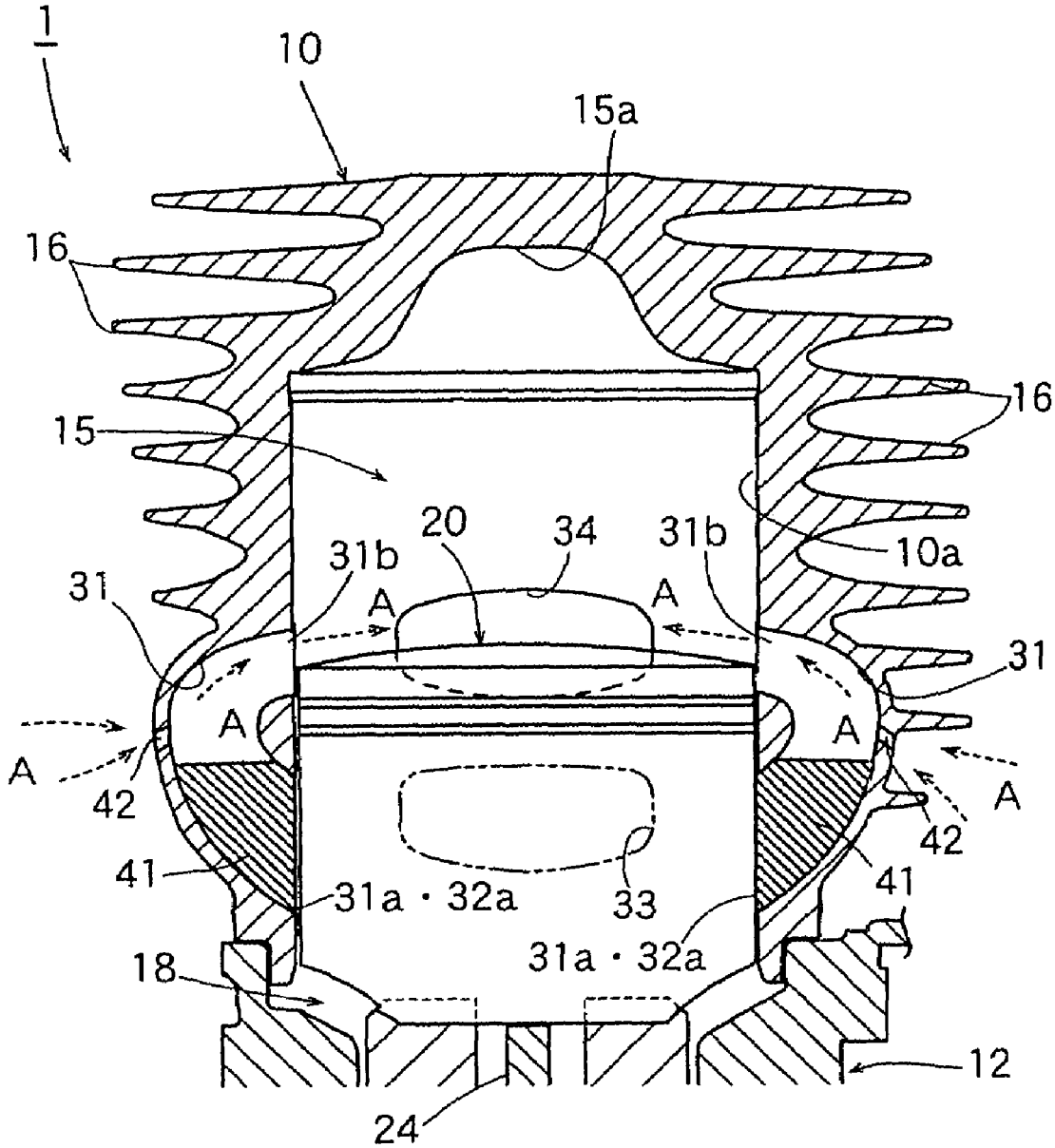
FIG. 6 is a longitudinal sectional view which corresponds to the structure shown in FIG. 2 for illustrating a second embodiment of the present invention, wherein the piston is positioned close to the bottom dead center.
Figure 7:
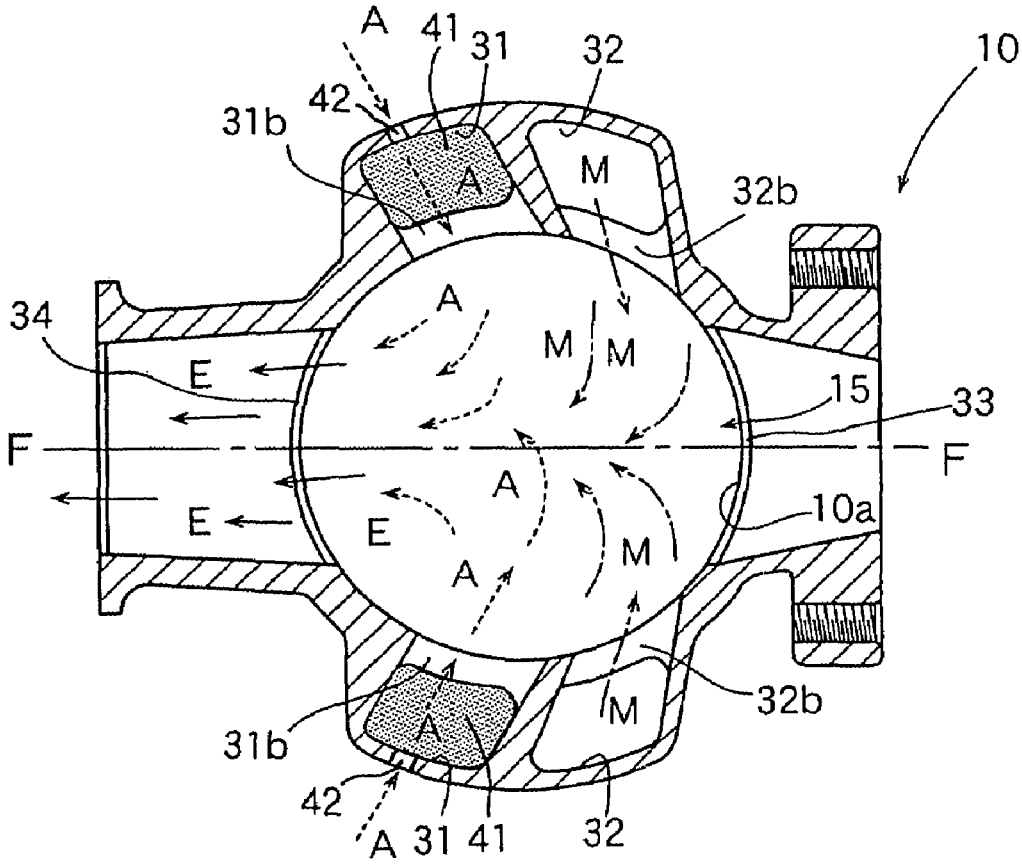
FIG. 7 shows a cross-sectional view corresponding to the structure shown in FIG. 4 for illustrating a second embodiment of the present invention.

FIGS. 6 and 7 show a second embodiment of the present invention. In this second embodiment, a pair of right and left scavenging passages (the first scavenging passageways 31) which are located closer to the exhaust port 34 among the entire scavenging passages 31 and 32 are blocked by stuffing a blocking member 41 into one end portion thereof, i.e. a portion where the scavenging inlet port 31*a* or 32*a* is located. The scavenging passages 31 whose inlet side is blocked in this manner include, in the vicinity of the scavenging outlet ports 31*b*, an external air inlet port 42 in order to introduce external air "A" into a region of the scavenging passage 31 which is located close to the exhaust port 34 prior to the introduction of air-fuel mixture M to be introduced into the combustion actuating chamber 15 from other scavenging outlet ports 32*b* in the descending stroke of the piston 20. Even with this second embodiment, it is possible, in the same manner as in the case of the first embodiment, to obtain stratiform scavenging effects. As a result, it is possible to minimize the quantity of blow-by, and to improve not only the emission characteristics but also the fuel consumption and output of engine.

Figure 8:
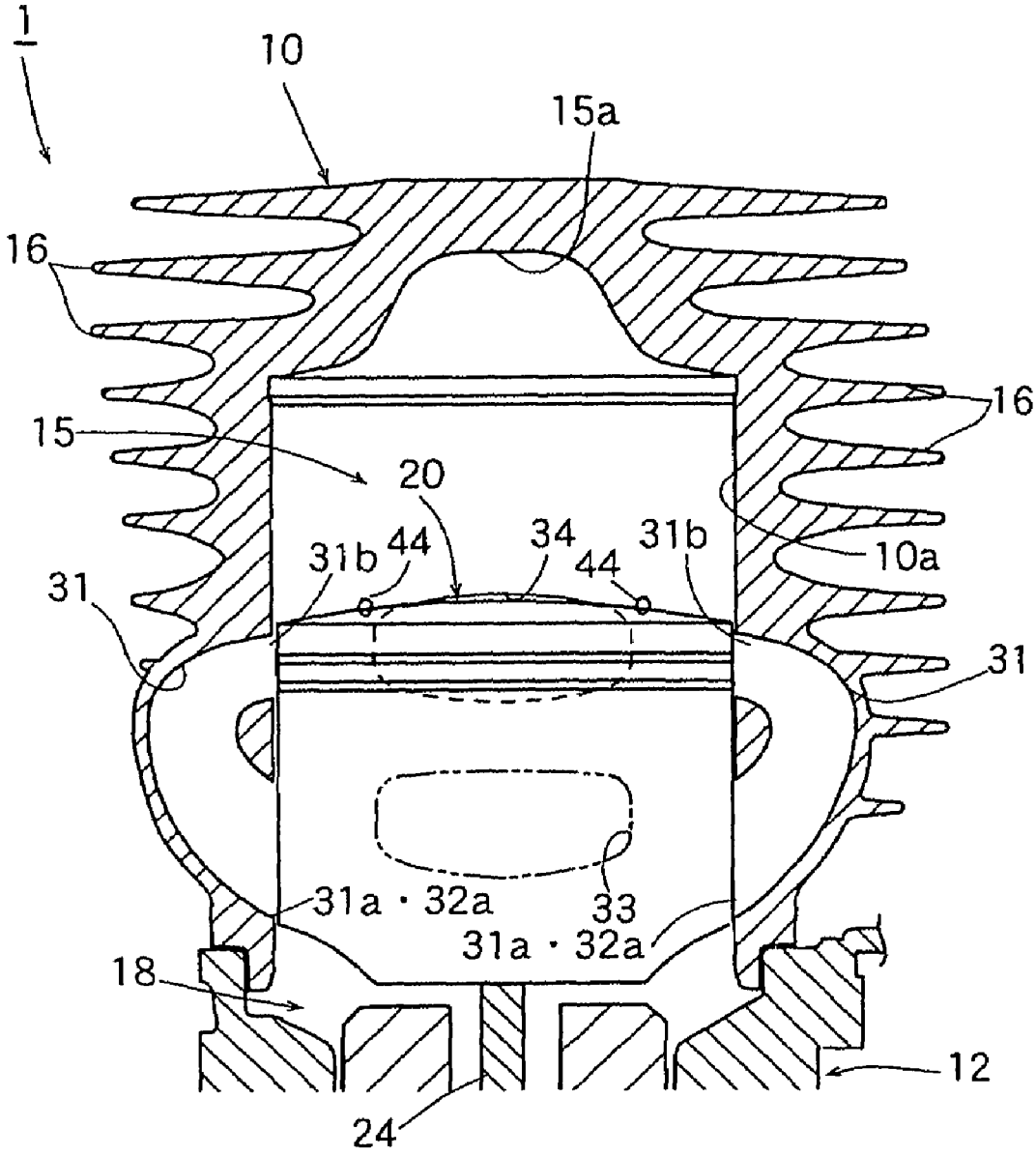
FIG. 8 is a longitudinal sectional view corresponding the structure shown in FIG. 4 for illustrating a third embodiment of the present invention, showing a state where the piston begins to open an exhaust port.
Figure 9:
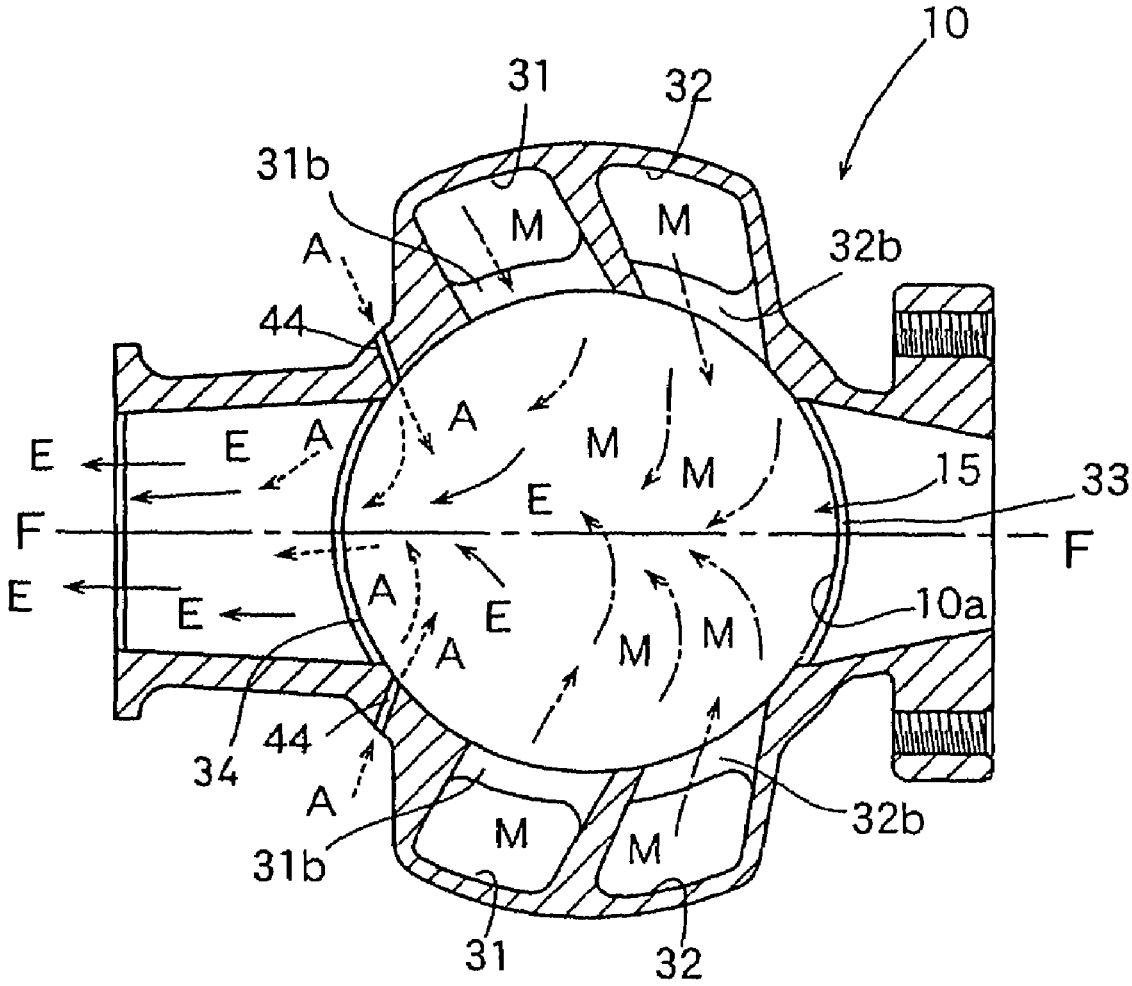
FIG. 9 shows a cross-sectional view corresponding to the structure shown in FIG. 4 for illustrating a third embodiment of the present invention.
Figure 10:
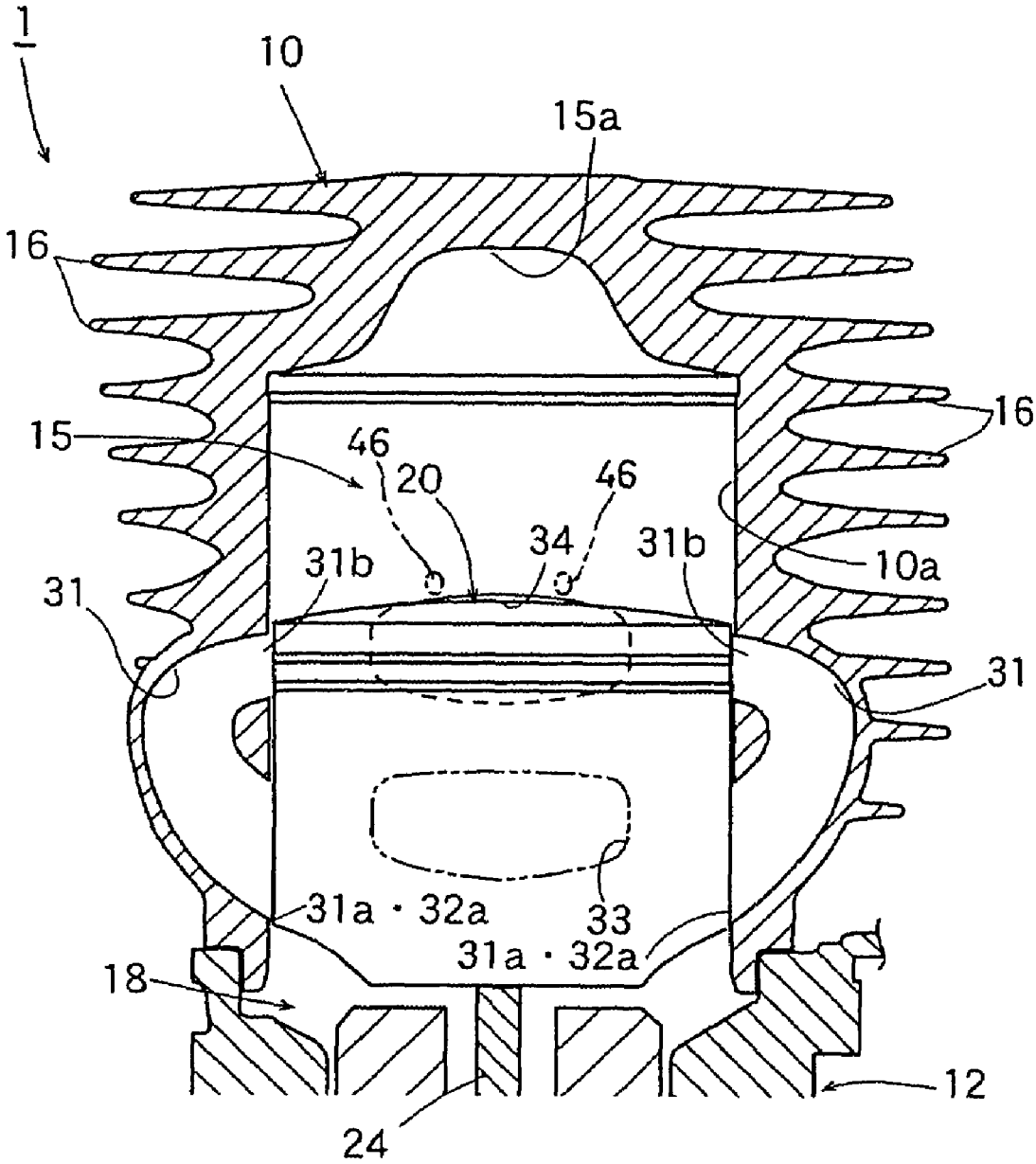
FIG. 10 is a longitudinal sectional view corresponding the structure shown in FIG. 2 for illustrating a fourth embodiment of the present invention, showing a state where the piston begins to open an exhaust port.
Figure 11:
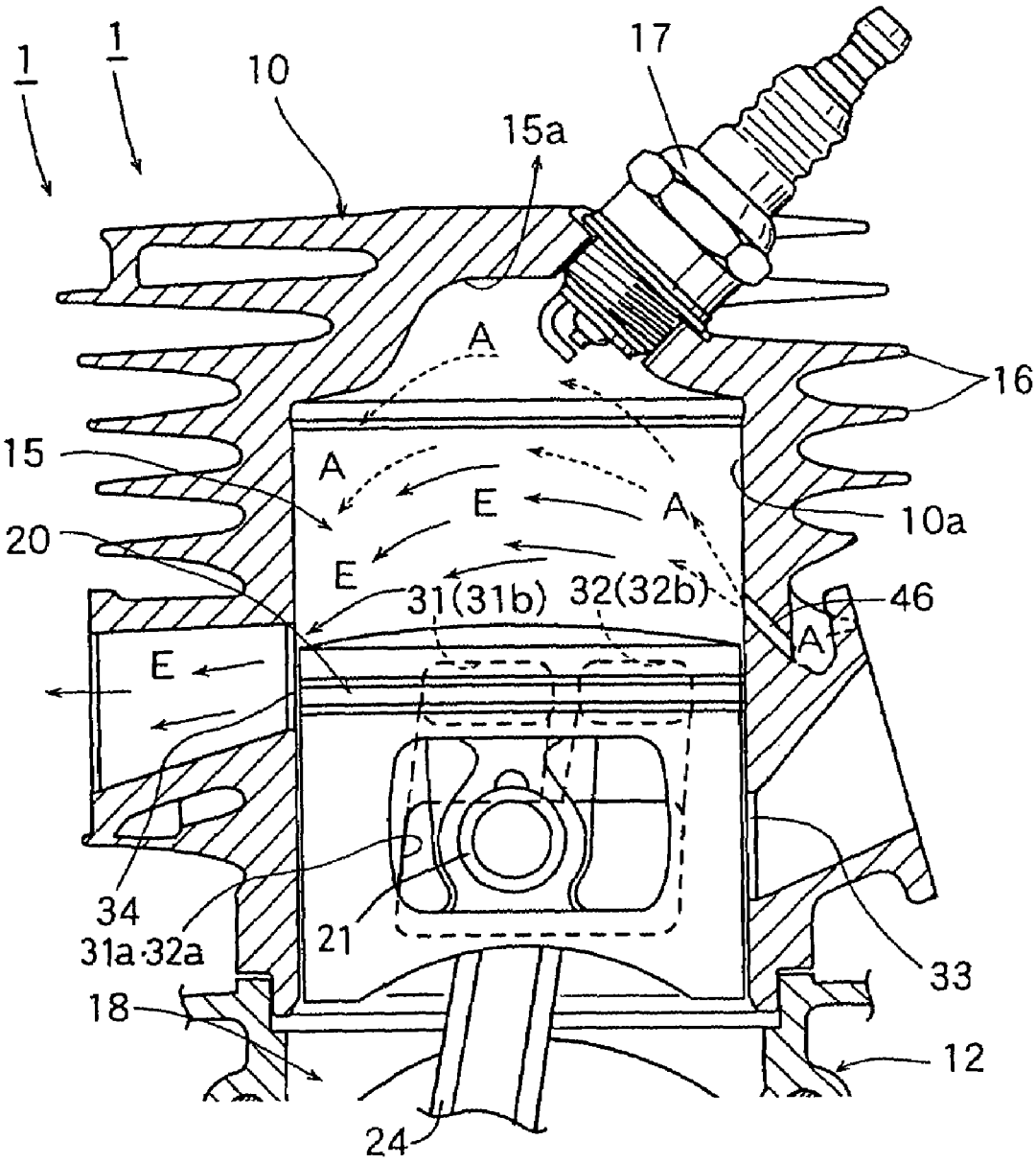
FIG. 11 is a longitudinal sectional view corresponding the structure shown in FIG. 3 for illustrating a fourth embodiment of the present invention, showing a state where the piston begins to open an exhaust port.
Figure 12:
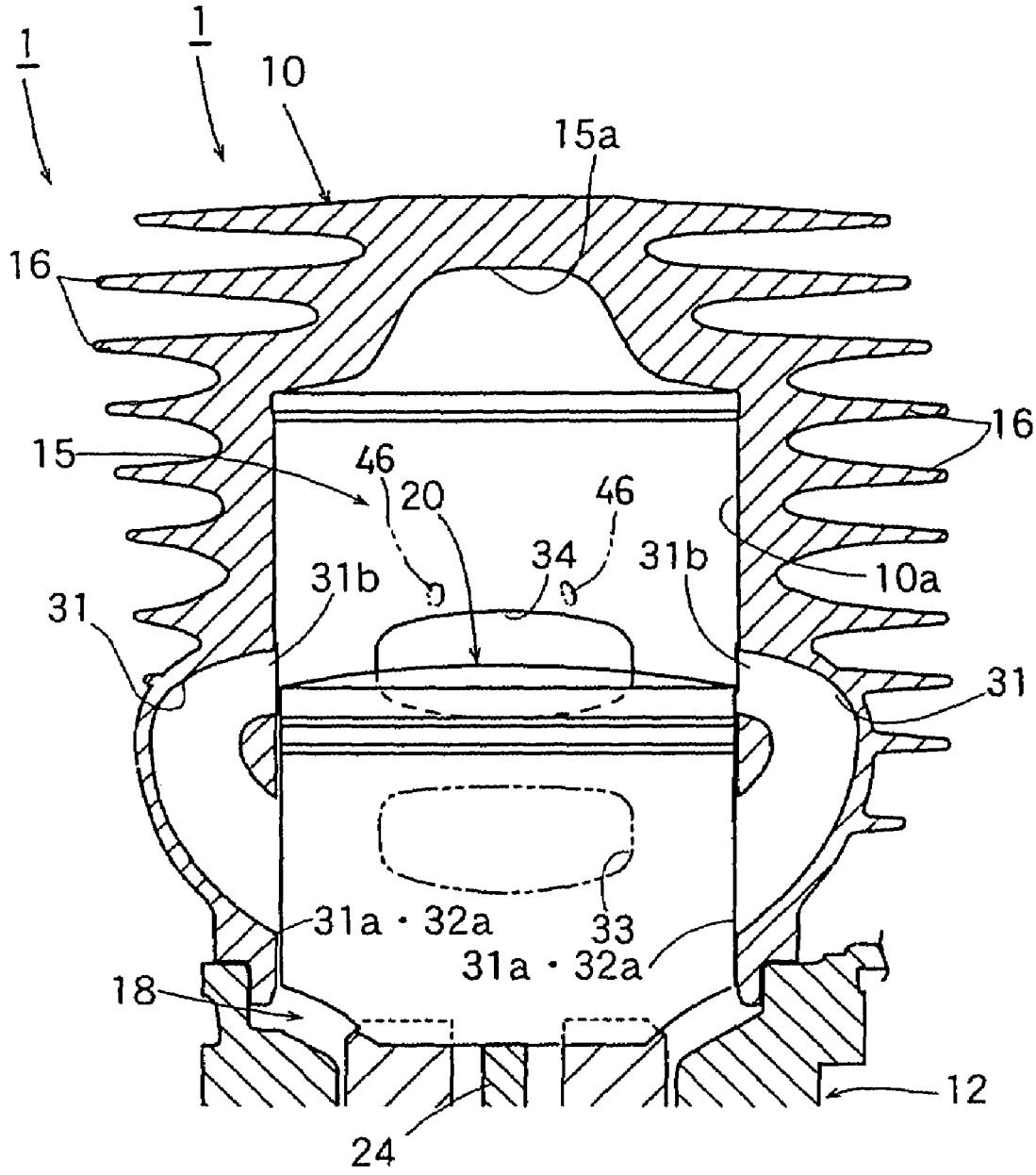
FIG. 12 is a longitudinal sectional view corresponding the structure shown in FIG. 2 for illustrating a fourth embodiment of the present invention, wherein the piston is positioned close to the bottom dead center.

FIGS. 8 and 9 show a third embodiment of the present invention. In this third embodiment, a pair of right and left scavenging passages a pair of external air inlet ports 44 are formed close to the exhaust port 34, i.e. at regions of the cylinder 10 which are located more close to the exhaust port 34 than the scavenging passages 31 are located. According to this third embodiment, it is possible, especially in the initial stage of the scavenging stroke, to obtain excellent stratiform scavenging effects. As a result, it is possible to minimize the quantity of blow-by, and to improve not only the emission characteristics but also the fuel consumption and output of engine.

FIGS. 10, 11, 12 and 13 show a fourth embodiment of the present invention. In this fourth embodiment, a couple of external air inlet ports 46 are formed close to the intake port 34 in such a manner that they are inclined upward and directed toward the combustion chamber 15*a*. Further, these external air inlet ports 46 are designed to be opened before the exhaust port 34 is opened in the descending stroke of the piston 20. In contrast to the first, second and third embodiments where the external air "A" is introduced toward a region located closer to the exhaust port 34 than the region to which the air-fuel mixture M is to be introduced on the occasion of introducing the air-fuel mixture M into the combustion actuating chamber 15 formed above the piston 20 from the scavenging outlet ports 32*b* in the ascending stroke of piston 20, the two-stroke internal combustion engine according to this fourth embodiment is designed such that the external air "A" is introduced toward the combustion actuating chamber 15 prior to the introduction of the air-fuel mixture M into the combustion actuating chamber 15. Consequently, in contrast to the first, second and third embodiments, a 3-ply layer consisting of a layer of waste combustion gas E, a layer of air "A", and a layer of air-fuel mixture M is formed not in a laterally stratified manner but in a vertically stratified manner in this fourth embodiment. Even with the vertical stratiform scavenging effects described above, it is possible to minimize the quantity of blow-by, and to improve not only the emission characteristics but also the fuel consumption and output of engine.

What is claimed is:

1. A two-stroke internal combustion engine comprising:

a cylinder having a bore, the cylinder including a combustion chamber, an intake port, and an exhaust port;

a first scavenging passageway having a first scavenging inlet port, and a first scavenging outlet port, the first scavenging outlet port being open to the bore of the cylinder;

a second scavenging passageway having a second scavenging inlet port, and a second scavenging outlet port, the second scavenging outlet port being open to the bore of the cylinder; and an external air inlet port for introducing external air into the combustion chamber;

wherein:

the external air inlet port is in a portion of the cylinder located at a distance from the exhaust port which is smaller than a distance from the second scavenging outlet port to the exhaust port;

the second scavenging outlet port is adapted to introduce an air-fuel mixture into the combustion chamber during a descending stroke of the piston; and the first scavenging passageway and the second scavenging passageway are approximately adjacent to each other.

2. The two-stroke internal combustion engine of claim 1, wherein the external air inlet port is capable of receiving air blast from a fan driven by a crankshaft of the two-stroke internal combustion engine.

3. The two-stroke internal combustion engine of claim 2, further comprising a wall near the external air inlet port adapted to guide the air blast into the combustion chamber from the fan.

4. The two-stroke internal combustion engine of claim 1, wherein the first scavenging inlet port is closed and the external air inlet port is formed close to the first scavenging outlet port.

5. The two-stroke internal combustion engine of claim 4, which further comprises:

a third scavenging passageway having a third scavenging inlet port, and a third scavenging outlet port, the third scavenging outlet port being open to the bore of the cylinder;

a fourth scavenging passageway having a fourth scavenging inlet port, and a fourth scavenging outlet port, the fourth scavenging outlet port being open to the bore of the cylinder;

wherein:

the fourth scavenging outlet port is adapted to introduce an air-fuel mixture into the combustion chamber during a descending stroke of the piston; and the third scavenging passageway and the fourth scavenging passageway are approximately adjacent to each other.

6. The two-stroke internal combustion engine of claim 5, further comprising a further external air inlet port for introducing external air into the combustion chamber, wherein the third scavenging inlet port is closed and the further external air inlet port is formed close to the third scavenging outlet port.

7. The two-stroke internal combustion engine of claim 1, wherein the first scavenging inlet port is closed and the external air inlet port is formed in the first scavenging outlet port.

8. The two-stroke internal combustion engine of claim 6, wherein the further external air inlet port is formed in the third scavenging outlet port.

9. The two-stroke internal combustion engine of claim 1, wherein the external air inlet port is located closer to the exhaust port than to the first scavenging outlet port.

10. A two-stroke internal combustion engine comprising:

a cylinder having a bore, the cylinder including a combustion chamber; and a cylinder having a bore, the cylinder including a combustion chamber, an intake port, and an exhaust port;

a first scavenging passageway having a first scavenging inlet port, and a first scavenging outlet port, the first scavenging outlet port being open to the bore of the cylinder;

a second scavenging passageway having a second scavenging inlet port, and a second scavenging outlet port, the second scavenging outlet port being open to the bore of the cylinder; and an external air inlet port for introducing external air into the combustion chamber;

wherein the external air inlet port is formed at a portion of the cylinder which enables the external air to be introduced into the combustion chamber prior to introduction of the air-fuel mixture.

11. The two-stroke internal combustion engine of claim 10, wherein the external air inlet port is capable of receiving air blast from a fan driven by a crankshaft of the two-stroke internal combustion engine.

12. The two-stroke internal combustion engine of claim 11, further comprising a wall near the external air inlet port adapted to guide the air blast into the combustion chamber from the fan.

13. The two-stroke internal combustion engine of claim 11, wherein the external air inlet port is formed near the intake port of the cylinder and inclined along a direction of the combustion chamber and adapted to be opened before the exhaust port is opened during a descending stroke of the piston.

* * * * *